US010017233B2

(12) United States Patent
Ajello

(10) Patent No.: US 10,017,233 B2
(45) Date of Patent: Jul. 10, 2018

(54) JET-POWERED OAR SYSTEM FOR A PADDLE BOARD

(71) Applicant: Mike Ajello, villa park, CA (US)

(72) Inventor: Mike Ajello, villa park, CA (US)

( * ) Notice: Subject to any disclaimer, the term of this patent is extended or adjusted under 35 U.S.C. 154(b) by 0 days.

(21) Appl. No.: 15/649,573

(22) Filed: Jul. 13, 2017

(65) Prior Publication Data

US 2018/0015993 A1 Jan. 18, 2018

Related U.S. Application Data

(60) Provisional application No. 62/361,834, filed on Jul. 13, 2016.

(51) Int. Cl.

*B63H 11/08* (2006.01)
*B63H 16/04* (2006.01)
*B63B 35/79* (2006.01)

(52) U.S. Cl.

CPC ..... *B63H 11/08* (2013.01); *B63H 16/04* (2013.01); *B63B 35/79* (2013.01); *B63H 2011/081* (2013.01)

(58) Field of Classification Search

CPC ..... B63H 16/00; B63H 16/04; B63H 16/06; B63H 11/08; B63B 35/79
USPC ..... 440/6, 101, 104, 105
See application file for complete search history.

(56) References Cited

U.S. PATENT DOCUMENTS

| | | | | |
|---|---|---|---|---|
| 8,512,086 | B1 * | 8/2013 | Charczuk | B63H 20/007 440/101 |
| 2007/0224894 | A1 * | 9/2007 | Kudrna | B63H 16/04 440/101 |
| 2011/0223816 | A1 * | 9/2011 | Boukas | B63H 16/04 440/6 |
| 2013/0035010 | A1 * | 2/2013 | Boukas | B63H 16/04 440/6 |

* cited by examiner

*Primary Examiner* — Lars A Olson

(57) ABSTRACT

A jet-powered oar system for a paddleboard designed to help paddle boarders travel long distances without feeling fatigue includes a propulsive oar and a restraining mechanism. The propulsive oar propels the paddle board without physical input from the paddle boarder. The restraining mechanism retrofits onto an existing paddleboard and retains the propulsive oar. The propulsive oar utilizes an oar shaft, an oar paddle, an impeller pump assembly, a primary battery pack, a kill switch, and an attachment collar. The oar shaft and the oar paddle can be used to physically propel the paddle board. The impeller pump assembly permits motorized propulsion of the paddle board when the paddle boarder succumbs to fatigue. The primary battery back stores electrical energy for powering the impeller pump assembly. The kill switch stops the paddle board from moving. Finally, the attachment collar couples the propulsive oar onto the restraining mechanism.

19 Claims, 7 Drawing Sheets

JET-POWERED OAR SYSTEM FOR A PADDLE BOARD

The current application claims a priority to the U.S. Provisional Patent application Ser. No. 62/361,834 filed on Jul. 13, 2016.

FIELD OF THE INVENTION

The present invention generally relates to jet-powered oar system for a paddle board. More specifically, the present invention comprises a propulsive oar, an impeller pump assembly integrated into the propulsive oar for generating forward thrust, and a restraining mechanism that retrofits onto an existing paddle board and secures the propulsive oar to the paddle board.

BACKGROUND OF THE INVENTION

Paddle boarding is a growing sport that provides a unique mix of physical exercise and a recreational experience. Paddle boarding allows paddlers to travel vast distance and experience the natural beauty of waterways such as rivers and oceans. Conventional paddleboards require paddlers to physically propel the paddleboards using oars. This can be used to exercise the body, build strong arms, and promote cardiovascular health.

The fact that paddle boarding exercises the body and allows paddlers to travel vast distances also causes problems. Sometimes paddlers can overextend themselves and travel further than they initially planned to. Other times, paddlers may feel excessive fatigue which prevents them from paddling back to where they started. It is also possible that paddlers may encounter an unexpected emergency that hinders their ability to physically propel the paddle board. For example, muscle cramps make it physically painful to move the effected limbs.

Nature is another unpredictable element that can prevent the paddler from reaching the desired destination. Thunderstorms can generate turbulent waves that make it virtually impossible to control the paddle board. This can cause the paddleboard to capsize and put the paddler in life-threatening situations. In these situations, it is imperative to get back to shore as soon as possible, Given these reasons, a way to propelling the paddle board independent of the paddler is needed. The present invention is a self-powered propulsion system that can be retrofitted onto an existing paddle board. The present invention utilizes a propulsive oar integrated with an electrically powered impeller pump assembly that propels the paddle board faster than physically possible. The present invention can help an exhausted paddler travel to the desired destination or escape from a dangerous situation.

DETAILED DESCRIPTION OF THE INVENTION

All illustrations of the drawings are for the purpose of describing selected versions of the present invention and are not intended to limit the scope of the present invention.

Figure 1:
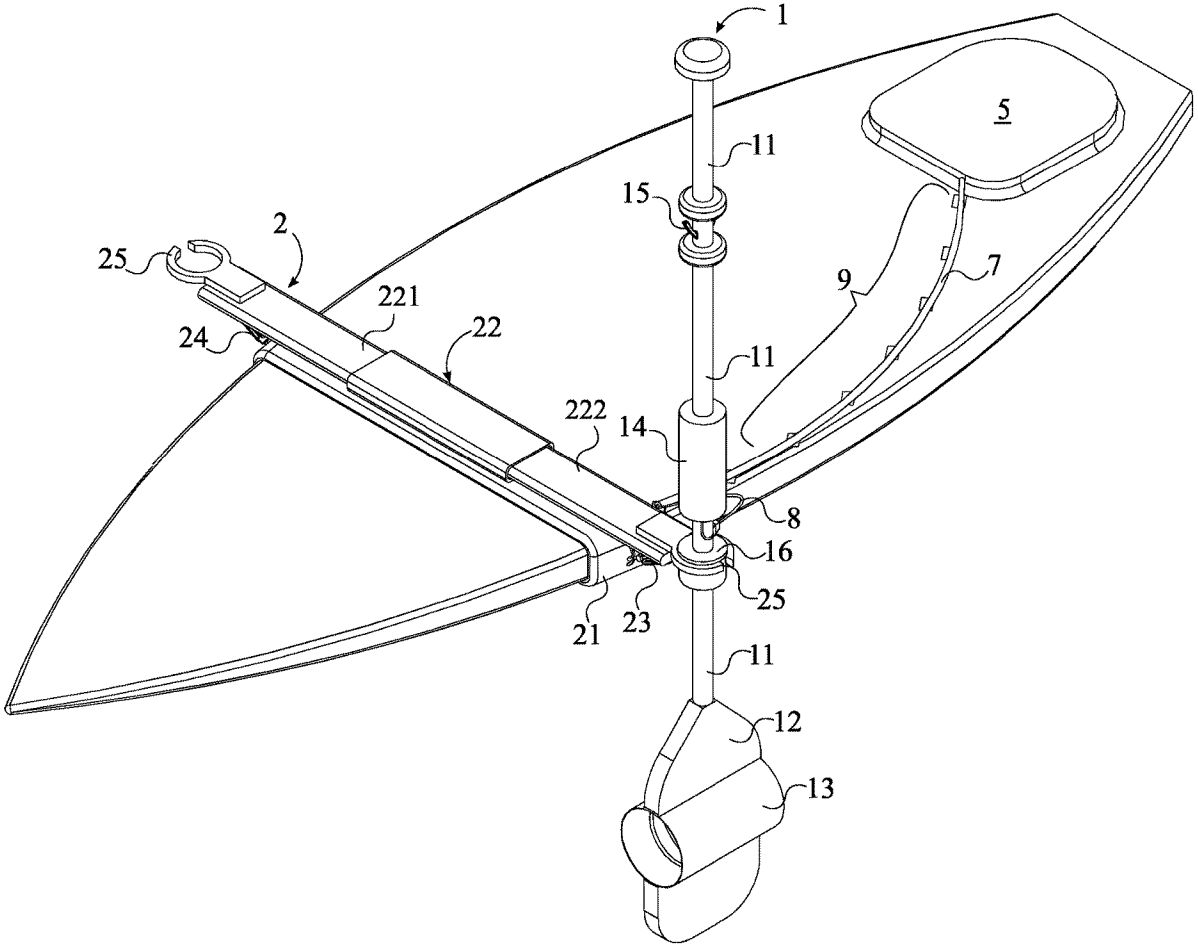
FIG. 1 is a front perspective view of the present invention.

In reference to FIG. 1, the present invention relates to a jet-powered oar system that is retrofittable onto a conventional paddle board. The preferred embodiment of the present invention comprises a propulsive oar 1 and a restraining mechanism 2. The restraining mechanism 2 selectively mounts the propulsive oar 1 to a conventional paddle board. The propulsive oar 1 uses an electrically powered propulsion system that propels the paddle board without physical input from the paddler. Alternately, the paddler can detach the propulsive oar 1 from the restraining mechanism 2 and use the propulsive oar 1 to physically propel the paddle board.

Figure 3:
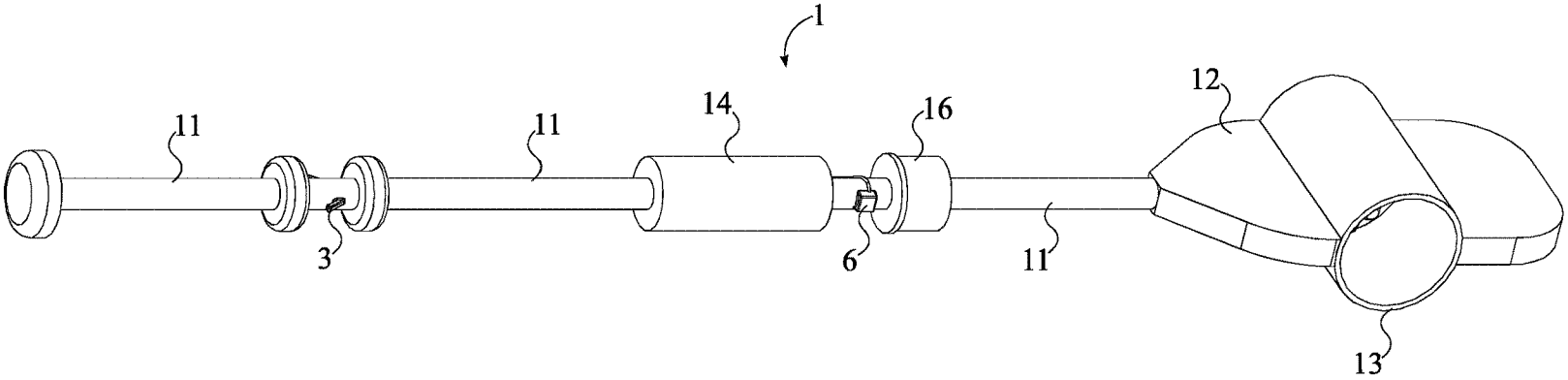
FIG. 3 is a horizontal perspective view of the propulsive oar.

In reference to FIG. 3, the propulsive oar 1 further comprises an oar shaft 11, an oar paddle 12, an impeller pump assembly 13, a primary battery pack 14, a kill switch 15, and an attachment collar 16. The oar paddle 12 is terminally connected to the oar shaft 11 which positions the oar paddle 12 below the water line. Moving the oar paddle 12 against the flow of the water, pushes the paddle board forward. This allows the present invention to move forward. The attachment collar 16 is laterally connected around the oar shaft 11. This prevents the propulsive oar 1 from detaching from the paddle board. Forward motion generated by the propulsive oar 1 is thus securely transferred to the paddle board. The impeller pump assembly 13 is integrated into the oar paddle 12. A rotation axis of the impeller pump assembly 13 is positioned parallel to the oar paddle 12. Water flows into impeller pump assembly 13, is accelerated, and expelled at a higher velocity. The change in momentum of the water is used to propel the propulsive oar 1 and the attached paddle board forward.

Referring again to FIG. 1, in the preferred implementation of the present invention, the primary battery pack 14 is integrated into the oar shaft 11 and positioned offset from the oar paddle 12. It is important to prevent moisture permeating through the battery, thus the primary battery pack 14 is positioned away from the waterline. The primary battery pack 14 is electrically connected to the impeller pump assembly 13 through the kill switch 15. Electrical energy transmits from the primary battery pack 14 to the impeller pump assembly 13 through the kill switch 15, which can stop the transmission and disable the impeller pump assembly 13. A handle is positioned on the oar shaft 11, opposite the oar paddle 12. The kill switch 15 is positioned proximal to the handle allowing the paddler to quickly actuate the kill switch 15 while holding on to the propulsive oar 1. Various additional control devices may be incorporated in the handle. For example, a navigation system may be incorporated into the handle to help paddlers navigate.

Figure 4:
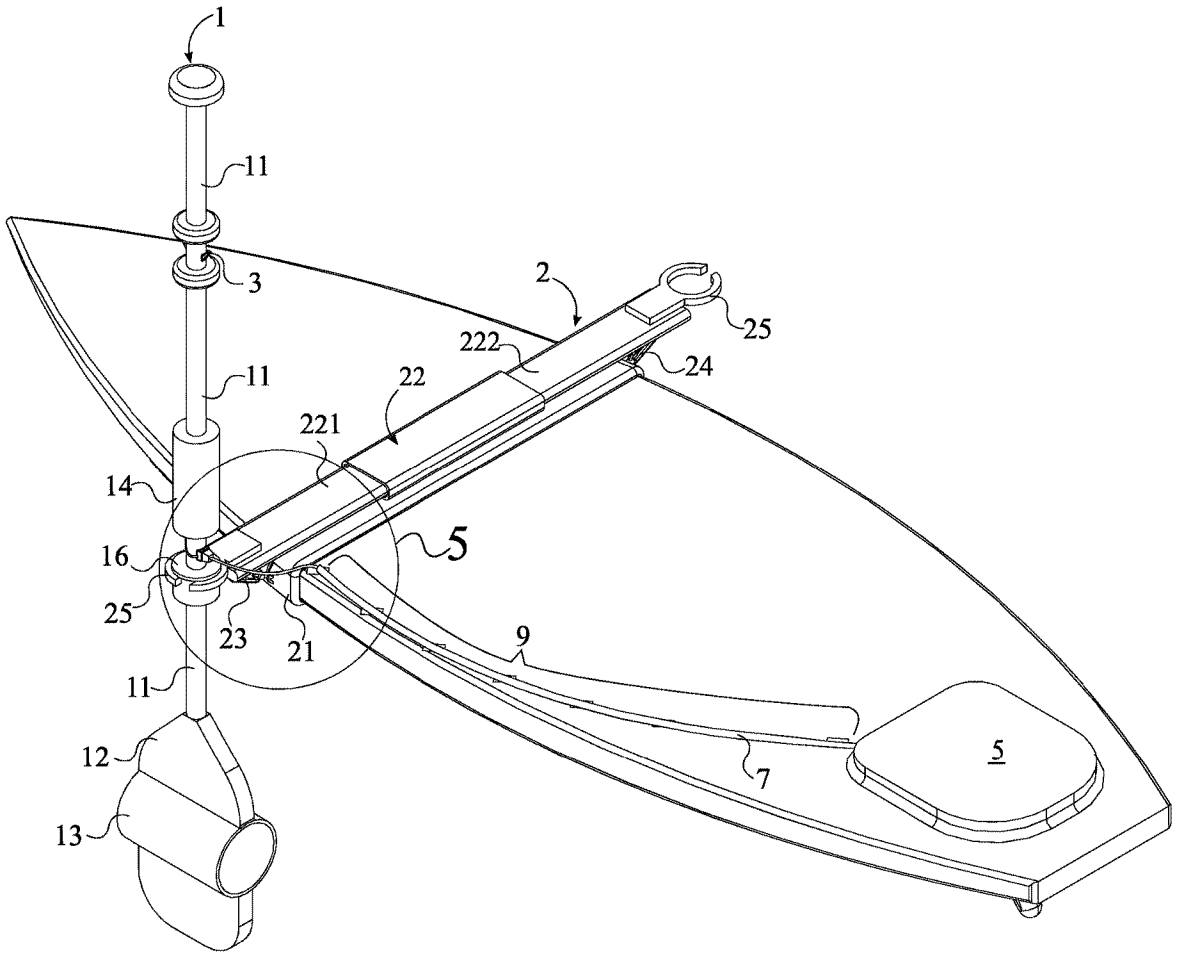
FIG. 4 is a rear perspective view of the propulsive oar and the restraining mechanism mounted onto a paddle board in the preferred manner.

In reference to FIG. 4, the restraining mechanism 2 comprises a strap 21 and a length-adjustable outrigger 22. In order to attach the length-adjustable outrigger 22, the strap 21 is laterally positioned around the paddle board. In the preferred embodiment of the present invention, the strap 21 is made of vinyl, but the strap 21 can be made of any flexible and waterproof material. The strap 21 is retrofitted onto an existing paddle board and the length-adjustable outrigger 22 is attached thereon. The length-adjustable outrigger 22 is laterally positioned along the strap 21. This allows the length-adjustable outrigger 22 to span the width of the paddle board. Consequently, the length-adjustable outrigger 22 is tensionably mounted to the strap 21. The length-adjustable outrigger 22 is used to rigidly connect the propulsive oar 1 to the paddle board, minimizing the movement from the desired position. Once mounted on the strap 21, the length-adjustable outrigger 22 is locked into position. The attachment collar 16 is terminally mounted to the length-adjustable outrigger 22, offset from the center of the paddle board. Once mounted, the length-adjustable outrigger 22 positions the attachment collar 16 to the side of the paddle board which allows the paddler to easily insert the propulsive oar 1 into the attachment collar 16.

Referring again to FIG. 2, the restraining mechanism 2 further comprises a pair of lockable braces 25. The pair of lockable braces 25 secure the attachment collar 16 to the length-adjustable outrigger 22. For this purpose, the pair of lockable braces 25 is terminally connected to the length-adjustable outrigger 22. The pair of lockable braces 25 are positioned opposite to each other along the length-adjustable outrigger 22. This submerges the oar paddle 12 under the water line, allowing the impeller pump assembly 13 to harness the water and generate thrust. The attachment collar 16 attaches into a selected brace from the pair of lockable braces 25. This arrangement permits the paddler to place the propulsive oar 1 on either side of the paddle board. In one possible embodiment of the present invention, each of the pair of lockable braces 25 comprises a hinge mechanism. The pair of lockable braces 25 can open and close by pivoting on the hinge mechanism. The hinge mechanism allows the pair of lockable braces 25 to lock into position around the attachment collar 16.

Figure 2:
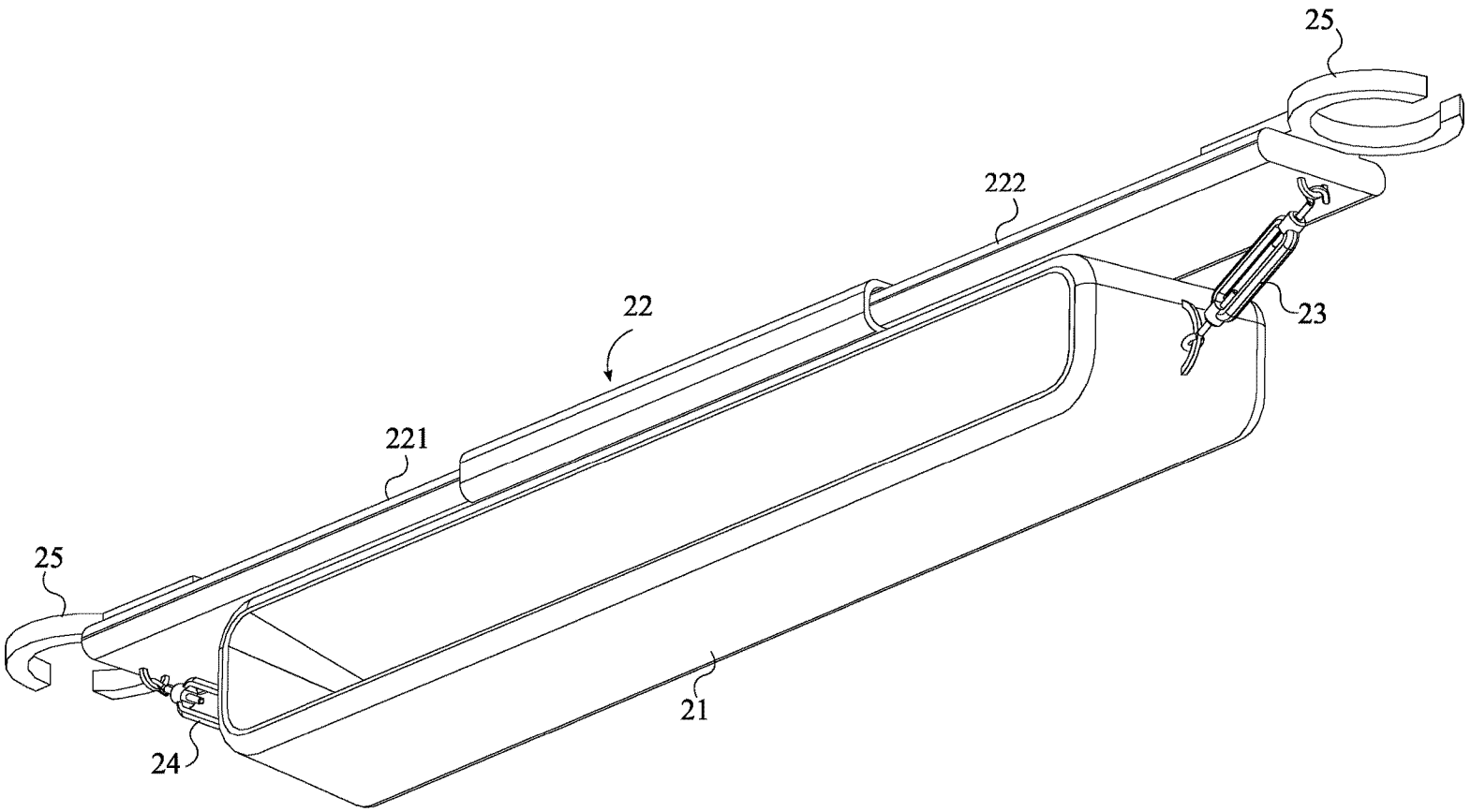
FIG. 2 is a bottom perspective view of the restraining mechanism.

In reference to FIG. 2, the restraining mechanism 2 further comprises a first turnbuckle 23 and a second turnbuckle 24. Both the first turnbuckle 23 and the second turnbuckle 24 preferably include two threaded eye bolts screwed into opposite ends of a metal frame. One eyebolt may have left-handed threads while the other may have right-handed threads. The distance between the eyebolts can be adjusted by turning the metal frame a certain direction. For example, turning the metal frame clockwise may drive the eyebolts apart, while turning the metal frame counter-clockwise may bring the eyebolts together. The ends of the eyebolts are fashioned with hooks that latch onto mounting points on the strap 21 and the length-adjustable outrigger 22. On one side, this allows the strap 21 to terminally mount to the length-adjustable outrigger 22 by the first turnbuckle 23. On the other side, the strap 21 is terminally mounted to the length-adjustable outrigger 22 by the second turnbuckle 24, opposite to the first turnbuckle 23. Alternate embodiments of the present invention may utilize a separate restraining mechanism 2 than the one disclosed. For example, one end of the strap 21 may be integrated into the paddle board and the other end may connect to the length-adjustable outrigger 22 via a single turnbuckle.

As can be seen in FIG. 2, the length-adjustable outrigger 22 comprises a first elongated member 221 and a second elongated member 222. Using a first elongated member 221 and a second elongated member 222 allows the present invention to span paddle boards having different widths. The first elongated member 221 and the second elongated member 222 are telescopically engaged to each other. Both the first elongated member 221 and the second elongated member 222 are mounted inside a center retaining base. This allows the paddler to adjust the length of the first elongated member 221 and the second elongated member 222 and to securely mount the length-adjustable outrigger 22 onto paddle boards having varying widths.

Figure 7:
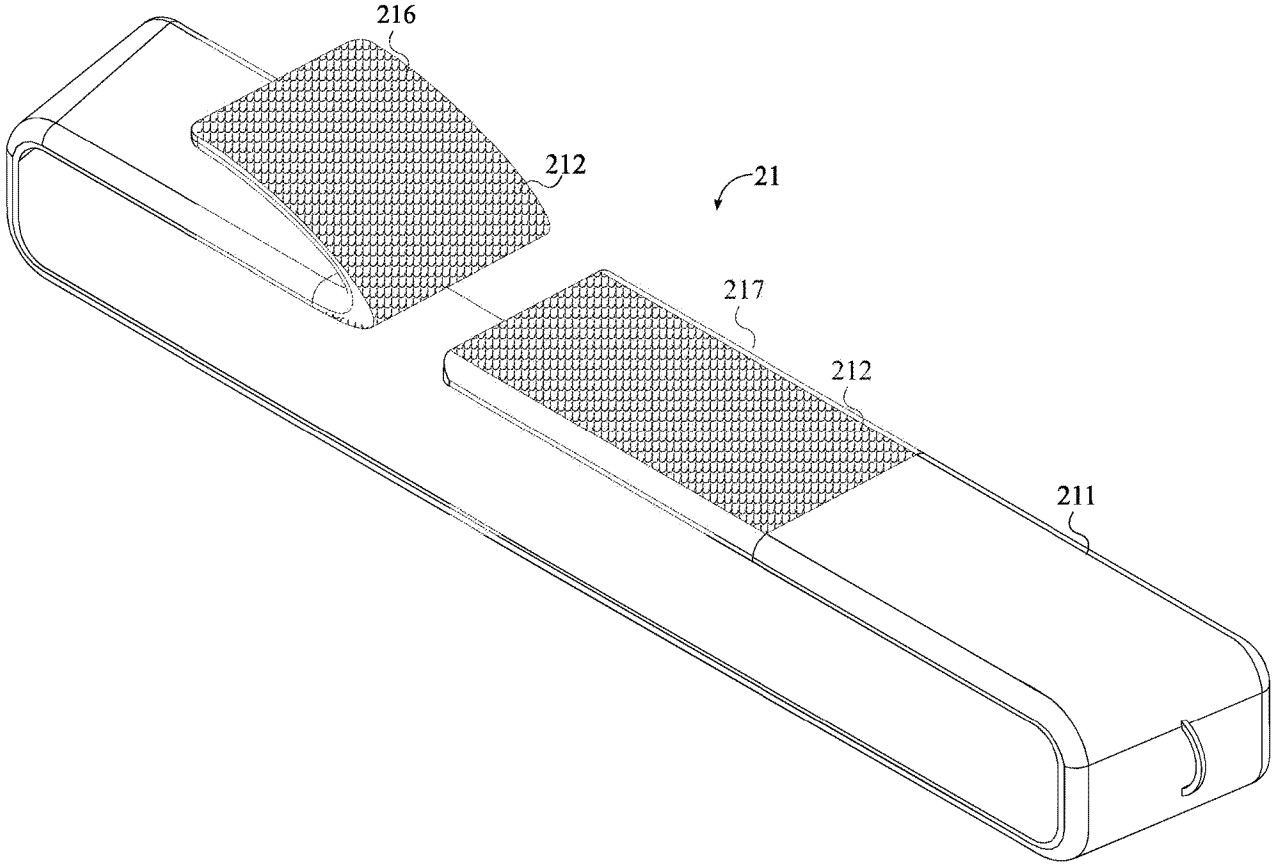
FIG. 7 is a front perspective view of the strap in the open position.

In reference to FIG. 7, the strap 21 comprises a strap body 211 and a hook-and-loop fastener 212. A first strap end 216 of the strap body 211 and a second strap end 217 of the strap body 211 are attached to each other by the hook-and-loop fastener 212. The hook-and-loop fastener 212 secures the connection between the strap 21 and the paddle board. Mounting points, in the form of loops, allows the first turnbuckle 23 and the second turnbuckle 24 to fasten onto the strap 21. The first turnbuckle 23 and the second turnbuckle 24 then secure the length-adjustable outrigger 22 onto the strap 21. In alternate embodiments, a buckle may enable the strap 21 to adjustably fasten onto a paddle board. The buckle enables the strap 21 to tighten around paddle boards having various widths.

As can be seen in FIG. 1, the present invention father comprises a variable speed control 3. The variable speed control 3 is integrated into the oar shaft 11, opposite the oar paddle 12. Electrical communication channels embedded into the oar shaft 11 allows the variable speed control 3 to electrically connect with the impeller pump assembly 13. In one possible embodiment of the present invention, the variable speed control 3 modulates the power supplied by the primary battery pack 14. This in turn control how much thrust is generated by the impeller pump assembly 13. A simple lever mechanism allows the paddler to physically interact with the variable speed control 3.

As can be seen in FIG. 4, the kill switch 15 is positioned adjacent to the variable speed control 3. Similar to the variable speed control 3, a physically actuatable lever mechanism controls operation of the kill switch 15. In one possible embodiment of the present invention, the kill switch 15 breaks electrical circuit between the impeller pump assembly 13 and the primary battery pack 14. The kill switch 15 can be used as an emergency stop mechanism that abruptly stops the paddle board and prevents a collision with an obstacle.

Figure 5:
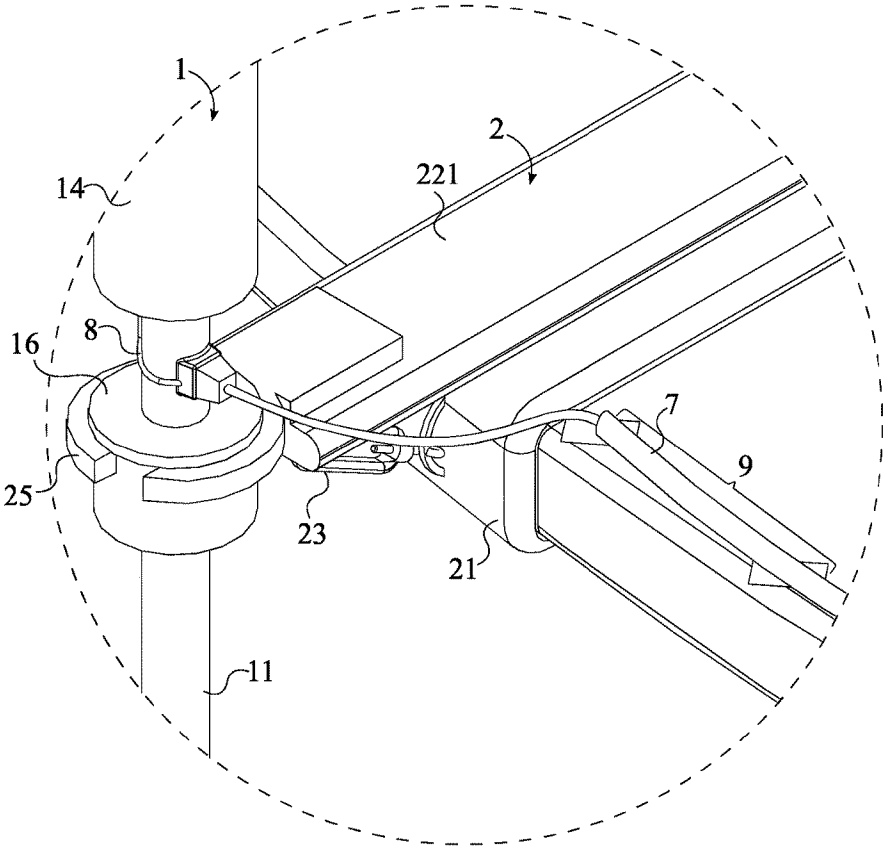
FIG. 5 is a detail view of taken about circle 5 in FIG. 4.

In reference to FIG. 5, the present invention further comprises a secondary battery pack 5, an electrical distribution hub 6, a first cord 7, and a second cord 8. The secondary battery pack 5 is mounted onto the paddle board. Once the power is drained from the primary battery pack 14, the secondary battery pack 5 allows the impeller pump assembly 13 to continue operating. As such, the secondary battery pack 5 includes high capacity energy storage that electrically powers the propulsive oar 1 for a prolonged period of operation. Consequently, the secondary battery pack 5 is much heavier that the primary battery pack 14 must be placed outside the propulsive oar 1. Preferably, a waterproof external housing 133 houses the secondary battery pack 5. The external housing 133 prevents water or moisture penetrating into the secondary battery pack 5 and interfering with the electrical circuitry.

Referring once more to FIG. 5, the electrical distribution hub 6 is laterally mounted around the oar shaft 11. Electrical energy supplied by the secondary battery pack 5 travels to the primary battery supply via the electrical distribution hub 6. As a result, the secondary battery pack 5 is electrically connected to the electrical distribution hub 6 by the first cord 7. Further, the electrical distribution hub 6 is electrically connected to the impeller pump assembly 13 by the second cord 8. In the preferred embodiment of the present invention, the electrical distribution hub 6 is a socket. The second cord 8 may be integrated into the electrical distribution hub 6. In order to transfer electrical energy from the secondary battery pack 5 to the propulsive oar 1, the first cord 7 inserts into the socket. This creates an electrical connection between the first cord 7 and the second cord 8 and enables power to flow from the secondary battery pack 5 into the impeller pump assembly 13.

As can be seen in FIG. 1, an adhesive strip 9 affixes the first cord 7 on top of the paddle board. The preferred adhesive strip 9 utilizes a plurality of peel and stick tapes placed on the top surface of the paddle board. However, any adhesive fastening mechanism can be used in alternate embodiments. The first cord 7 is laterally connected along the adhesive strip 9.

Figure 6:
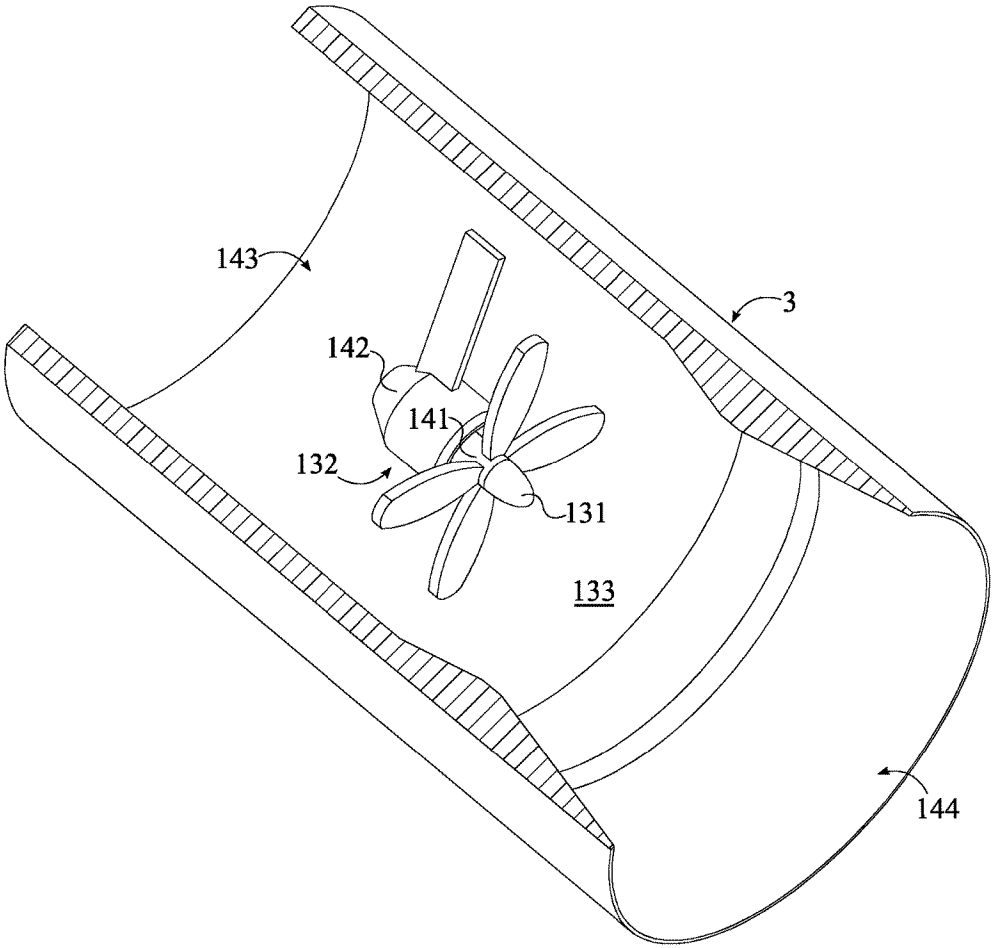
FIG. 6 is a cross sectional view of the impeller pump assembly.

In reference to FIG. 6, the preferred embodiment of the impeller pump assembly 13 comprises an impeller 131, a motor 132, and a housing 133. The housing 133 further comprises an inlet 143 and an outlet 144. Water flows into the housing 133 via the inlet 143 and exits through an outlet 144. The motor 132 further comprises a rotor 141 and a stator 142. In order to drive the impeller 131, the stator 142 is held static in relation to the rotor 141. In addition, the impeller 131 is fixedly attached to the rotor 141. The inlet 143, the impeller 131, and the outlet 144 are coaxially positioned to the rotation axis of the impeller pump assembly 13. The inlet 143 harnesses the incoming flow of water and directs it in front of the impeller 131. This maximizes the cross-sectional area of the impeller 131 in contact with the incoming flow.

Referring again to FIG. 6, the impeller 131 is positioned in between the inlet 143 and the outlet 144. As the water flows through the housing 133, the impeller 131 accelerates the flow rate between the inlet 143 and the outlet 144. The impeller 131 is rotatably mounted within the housing 133. Spinning the impeller 131 creates an area of low pressure behind the impeller 131 and accelerates the flow of water through the impeller pump assembly 13. Change in flow rate between the inlet 143 and the outlet 144 determines the thrust generated by the impeller 131. This thrust propels the paddle board forward. The stator 142 is mounted within the housing 133. To enable the motor 132 to operate while remaining submerged under water, both the rotor 141 and stator 142 may be contained in a watertight enclosure within the housing 133. This allows the motor 132 to mount behind the impeller 131 positioned below the water line without the danger of a short. The rotor 141 is torsionally connected to the impeller 131. As a result, when electrical current is applied to the stator 142, the rotor 141 and the impeller 131 start to spin together.

Although the invention has been explained in relation to its preferred embodiment, it is to be understood that many other possible modifications and variations can be made without departing from the spirit and scope of the invention as hereinafter claimed.

What is claimed is:

1. A jet-powered oar system for a paddle board comprises:
- a propulsive oar;
- a restraining mechanism;
- the propulsive oar comprises an oar shaft, an oar paddle, an impeller pump assembly, a primary battery pack, a kill switch, and an attachment collar;
- the oar paddle being terminally connected to the oar shaft;
- the attachment collar being laterally connected around the oar shaft;
- the attachment collar being laterally attached to the restraining mechanism;
- the impeller pump assembly being integrated into the oar paddle;
- a rotation axis of the impeller pump assembly being positioned parallel to the oar paddle;
- the primary battery pack being integrated into the oar shaft;
- the primary battery pack being positioned offset from the oar paddle; and
- the primary battery pack being electrically connected to the impeller pump assembly through the kill switch.

2. The jet-powered oar system as claimed in claim 1 comprises:
- the restraining mechanism comprises a strap and a length-adjustable outrigger;
- the length-adjustable outrigger being laterally positioned along the strap;
- the length-adjustable outrigger being tensionably mounted to the strap; and
- the attachment collar being terminally mounted to the length-adjustable outrigger.

3. The jet-powered oar system for a paddle board as claimed in claim 2 comprises:
- the restraining mechanism further comprises a first turnbuckle and a second turnbuckle;
- the strap being terminally mounted to the length-adjustable outrigger by the first turnbuckle; and
- the strap being terminally mounted to the length-adjustable outrigger by the second turnbuckle, opposite to the first turnbuckle.

4. The jet-powered oar system for a paddle board as claimed in claim 2 comprises:
- the restraining mechanism further comprises a pair of lockable braces;
- the pair of lockable braces being terminally connected to the length-adjustable outrigger;
- the pair of lockable braces being positioned opposite to each other along the length-adjustable outrigger; and
- the attachment collar being attached into a selected brace from the pair of lockable braces.

5. The jet-powered oar system for a paddle board as claimed in claim 2 comprises:
- the length-adjustable outrigger comprises a first elongated member and a second elongated member; and
- the first elongated member and the second elongated member being telescopically engaged to each other.

6. The jet-powered oar system for a paddle board as claimed in claim 2 comprises:
- the strap comprises a strap body and a hook-and-loop fastener; and
- a first strap end of the strap body and a second strap end of the strap body being attached to each other by the hook-and-loop fastener.

7. The jet-powered oar system for a paddle board as claimed in claim 1 comprises:
- a variable speed control,
- the variable speed control being integrated into the oar shaft, opposite the oar paddle; and
- the variable speed control being electronically connected to the impeller pump assembly.

8. The jet-powered oar system for a paddle board as claimed in claim 7 comprises:
- the kill switch being positioned adjacent to the variable speed control.

9. The jet-powered oar system for a paddle board as claimed in claim 1 comprises:
- a secondary battery pack;
- an electrical distribution hub;
- a first cord;
- a second cord;
- the electrical distribution hub being laterally mounted around the oar shaft;

the secondary battery pack being tethered to the electrical distribution hub by the first cord;

the secondary battery pack being electrically connected to the electrical distribution hub by the first cord; and the electrical distribution hub being electrically connected to the impeller pump assembly by the second cord.

10. The jet-powered oar system for a paddle board as claimed in claim 9 comprises:

an adhesive strip; and the first cord being laterally connected along the adhesive strip.

11. The jet-powered oar system for a paddle board as claimed in claim 1 comprises:

the impeller pump assembly comprises an impeller, a motor, and a housing;

the housing comprises an inlet and an outlet;

the motor comprises a rotor and a stator;

the inlet, the impeller, and the outlet being coaxially positioned to the rotation axis of the impeller pump assembly;

the impeller being positioned in between the inlet and the outlet;

the impeller being rotatably mounted within the housing;

the stator being mounted within the housing; and the rotor being torsionally connected to the impeller.

12. A jet-powered oar system for a paddle board comprises:

a propulsive oar;

a restraining mechanism;

the propulsive oar comprises an oar shaft, an oar paddle, an impeller pump assembly, a primary battery pack, a kill switch, and an attachment collar;

the restraining mechanism comprises a strap and a length-adjustable outrigger;

the oar paddle being terminally connected to the oar shaft;

the attachment collar being laterally connected around the oar shaft;

the attachment collar being laterally attached to the restraining mechanism;

the impeller pump assembly being integrated into the oar paddle;

a rotation axis of the impeller pump assembly being positioned parallel to the oar paddle;

the primary battery pack being integrated into the oar shaft;

the primary battery pack being positioned offset from the oar paddle;

the primary battery pack being electrically connected to the impeller pump assembly through the kill switch;

the length-adjustable outrigger being laterally positioned along the strap;

the length-adjustable outrigger being tensionably mounted to the strap;

and the attachment collar being terminally mounted to the length-adjustable outrigger.

13. The jet-powered oar system as claimed in claim 12 comprises:

the restraining mechanism further comprises a first turnbuckle and a second turnbuckle;

the restraining mechanism further comprises a pair of lockable braces;

the strap being terminally mounted to the length-adjustable outrigger by the first turnbuckle;

the strap being terminally mounted to the length-adjustable outrigger by the second turnbuckle, opposite to the first turnbuckle;

the pair of lockable braces being terminally connected to the length-adjustable outrigger;

the pair of lockable braces being positioned opposite to each other along the length-adjustable outrigger; and the attachment collar being attached into a selected brace from the pair of lockable braces.

14. The jet-powered oar system for a paddle board as claimed in claim 12 comprises:

a variable speed control, the variable speed control being integrated into the oar shaft, opposite the oar paddle; and the variable speed control being electronically connected to the impeller pump assembly.

15. The jet-powered oar system for a paddle board as claimed in claim 14 comprises:

the kill switch being positioned adjacent to the variable speed control.

16. The jet-powered oar system for a paddle board as claimed in claim 12 comprises:

a secondary battery pack;

an electrical distribution hub;

a first cord;

a second cord;

an adhesive strip;

the electrical distribution hub being laterally mounted around the oar shaft;

the secondary battery pack being tethered to the electrical distribution hub by the first cord;

the secondary battery pack being electrically connected to the electrical distribution hub by the first cord;

the electrical distribution hub being electrically connected to the impeller pump assembly by the second cord; and the first cord being laterally connected along the adhesive strip.

17. The jet-powered oar system for a paddle board as claimed in claim 12 comprises:

the impeller pump assembly comprises an impeller, a motor, and a housing;

the housing comprises an inlet and an outlet;

the motor comprises a rotor and a stator;

the inlet, the impeller, and the outlet being coaxially positioned to the rotation axis of the impeller pump assembly;

the impeller being positioned in between the inlet and the outlet;

the impeller being rotatably mounted within the housing;

the stator being mounted within the housing; and the rotor being torsionally connected to the impeller.

18. A jet-powered oar system for a paddle board comprises:

a propulsive oar;

a restraining mechanism;

the propulsive oar comprises an oar shaft, an oar paddle, an impeller pump assembly, a primary battery pack, a kill switch, a variable speed control, and an attachment collar;

the impeller pump assembly further comprises an impeller, a motor, and a housing;

the oar paddle being terminally connected to the oar shaft;

the attachment collar being laterally connected around the oar shaft;

the attachment collar being laterally attached to the restraining mechanism;

the impeller pump assembly being integrated into the oar paddle;

a rotation axis of the impeller pump assembly being positioned parallel to the oar paddle;

the primary battery pack being integrated into the oar shaft;

the primary battery pack being positioned offset from the oar paddle;

the primary battery pack being electrically connected to the impeller pump assembly through the kill switch;

the housing comprises an inlet and an outlet;

the motor comprises a rotor and a stator;

the inlet, the impeller, and the outlet being coaxially positioned to the rotation axis of the impeller pump assembly;

the impeller being positioned in between the inlet and the outlet;

the impeller being rotatably mounted within the housing;

the stator being mounted within the housing;

the rotor being torsionally connected to the impeller;

the variable speed control being integrated into the oar shaft, opposite the oar paddle;

the variable speed control being electronically connected to the impeller pump assembly; and the kill switch being positioned adjacent to the variable speed control.

19. The jet-powered oar system for a paddle board as claimed in claim 18 comprises:

a secondary battery pack;

an electrical distribution hub;

a first cord;

a second cord;

an adhesive strip;

the electrical distribution hub being laterally mounted around the oar shaft;

the secondary battery pack being tethered to the electrical distribution hub by the first cord;

the secondary battery pack being electrically connected to the electrical distribution hub by the first cord;

the electrical distribution hub being electrically connected to the impeller pump assembly by the second cord; and the first cord being laterally connected along the adhesive strip.

* * * * *